US007717529B2

(12) United States Patent
Ito

(10) Patent No.: US 7,717,529 B2
(45) Date of Patent: May 18, 2010

(54) IMAGE RECORDING APPARATUS

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 29 days.

(21) Appl. No.: 12/251,806

(22) Filed: Oct. 15, 2008

(65) Prior Publication Data

US 2009/0102872 A1 Apr. 23, 2009

(30) Foreign Application Priority Data

Oct. 18, 2007 (JP) ..... 2007-270965

(51) Int. Cl.
*B41J 25/308* (2006.01)

(52) U.S. Cl. ..... 347/8; 347/19

(58) Field of Classification Search ..... 347/8
See application file for complete search history.

(56) References Cited

U.S. PATENT DOCUMENTS 7,334,859 B2 2/2008 Kojima
2003/0007023 A1* 1/2003 Barclay et al. ..... 347/8
2005/0046658 A1* 3/2005 Kojima ..... 347/19
2008/0111847 A1 5/2008 Kojima

FOREIGN PATENT DOCUMENTS

JP 2006-205742 A 8/2006

* cited by examiner

*Primary Examiner*—Matthew Luu
*Assistant Examiner*—Brian J Goldberg
(74) *Attorney, Agent, or Firm*—Baker Botts L.L.P.

(57) ABSTRACT

An image recording apparatus including: a medium-convey belt; a recording head; an image sensor being movable together with the recording head and including an image-pickup element, an image-forming optical system, and a light-entering surface which is more distant from the medium-convey belt than an ejection surface of the recording head, and a raising and lowering mechanism which positions the recording head, wherein the recording head is positioned, when in an inspecting mode in which the recording head is inspected, at a first height at which an optical image of an image recorded on the medium-convey belt or recorded on the recording medium on the medium-convey belt is formed on the image-pickup element by the image-forming optical system, while positioned, when in a normal recording mode, at a second height at which the ejection surface is more distant from the medium-convey belt than at the first height, and wherein the image sensor picks up the image when the recording head is positioned at the first height.

6 Claims, 9 Drawing Sheets

IMAGE RECORDING APPARATUS

CROSS REFERENCE TO RELATED APPLICATION

The present application claims priority from Japanese Patent Application No. 2007-270965, which was filed on Oct. 18, 2007, the disclosure of which is herein incorporated by reference in its entirety.

BACKGROUND OF THE INVENTION

1. Field of the Invention

The present invention relates to an image recording apparatus configured to eject liquid to record an image on a recording medium, and more particularly to an image recording apparatus equipped with an image sensor which picks up a recorded image.

2. Description of the Related Art

Recently, there has been developed an ink-jet printer using a line head having a recording range larger than a width of a recording sheet as a recording medium. In such a line printer, recording for each extremely narrow portion of the recording sheet extending in a direction in which the recording sheet is conveyed is carried out only by a corresponding one of nozzles. Thus, even where there are only a small number of nozzles in which an ink ejection failure occurs such as non-ejection of inks (liquids), variation of an ejected ink amount, and a deviation of a direction in which the inks are ejected, a white patch or line, or unevenness is formed or developed on the recording sheet, thereby deteriorating an image quality by a relatively large degree.

To solve this problem, in an ink-jet recording apparatus disclosed in Patent Document 1 (Japanese Patent Application Publication No. 2006-205742), image sensors of line type operable to read a test pattern recorded on a recording sheet are provided at respective positions each of which is adjacent to and located downstream of a corresponding one of recording heads in a direction in which the recording sheet is conveyed. Any nozzle in which an ink ejection failure occurs is detected on the basis of image data obtained by the image sensors of line type, and a prescribed recovering operation is performed for the nozzle. By a method like this, the nozzle in which the ink ejection failure occurs can be precisely detected to recover such nozzle.

SUMMARY OF THE INVENTION

In the ink-jet recording apparatus disclosed in Patent Document 1, lower surfaces of the respective image sensors are located below a height level of ejection surfaces of the respective recording heads. That is, the lower surfaces of the respective image sensors are located nearer to a belt for conveying the recording sheet than to the ejection surfaces of the respective recording heads. Thus, in both of a test pattern recording and a normal recording, ink mist tends to adhere to the lower surfaces (light-entering surfaces) of the respective image sensors. That is, the lower surfaces of the respective image sensors tend to be soiled. In addition, where the recording sheet is brought into contact with the lower surfaces of the respective image sensors due to jamming just after the inks have attached to the recording sheet, undried ink on the recording sheet unfortunately adheres to the lower surfaces of the respective image sensors. Where the inks have adhered to the lower surfaces of the respective image sensors, reliability of image data obtained by reading is lowered, so that unnecessary recovering operation is performed.

This invention has been developed in view of the above-described situations, and it is an object of the present invention to provide an image recording apparatus in which a lower surface of an image sensor that picks up an image recorded by recording heads is less soiled.

The object indicated above may be achieved according to the present invention which provides an image recording apparatus comprising: a medium-convey belt which conveys a recording medium; a recording head having an ejection surface in which a plurality of ejection openings for ejecting liquid are provided and which faces a surface of the medium-convey belt; an image sensor being integral with the recording head and being movable together with the recording head, and including an image-pickup element, a light-entering surface which faces the surface of the medium-convey belt, and which is more distant from the surface of the medium-convey belt than the ejection surface of the recording head, and an image-forming optical system which guides, to the image-pickup element, a light entered through the light-entering surface and which is for forming, on the image-pickup element, an optical image of an object, a raising and lowering mechanism which positions the recording head at a selected one of a plurality of heights including a first height and a second height, wherein the first height is a height at which the ejection surface is distant from the surface of the medium-convey belt, and the optical image of an image, as the object, recorded on the surface of the medium-convey belt or recorded on the recording medium on the medium-convey belt is formed on the image-pickup element by the image-forming optical system, and wherein the second height is a height at which the ejection surface is more distant from the surface of the medium-convey belt than at the first height; and a controller configured to execute controls for operations of the image recording apparatus, wherein the controller includes: a mode indicating section configured to indicate one of a normal recording mode and an inspecting mode, wherein in the normal recording mode, a desired image is recorded on the recording medium conveyed on the medium-convey belt while in the inspecting mode, the recording head is inspected; a raising and lowering controlling section configured to control the raising and lowering mechanism such that the recording head is positioned at the second height when the mode indicating section indicates the normal recording mode, and such that the recording head is positioned at the first height when the mode indicating section indicates the inspecting mode; a head controlling section configured to control the recording head such that the recording head ejects the liquid; and an image-pickup controlling section configured to control the image sensor such that the image sensor picks up the image recorded on the medium-convey belt or recorded on the recording medium on the medium-convey belt when the recording head is positioned at the first height.

In the image recording apparatus constructed as described above, since the image sensor is moved upward and downward together with the recording head in a state in which the image sensor is more distant from the surface of the medium-convey belt than the recording head, the light-entering surface of the image sensor is less soiled. Further, when the liquid is ejected as a test in the inspecting mode, since the distance between the ejection surface and the medium-convey belt or the recording medium on the medium-convey belt is shorter than that in the normal recording mode, an ejected-liquid-attaching accuracy upon recording can be improved. In addition, the light-entering surface of the image sensor can be less soiled due to flying liquid mist. Furthermore, since the ejected-liquid-attaching accuracy upon the recording can be improved, a liquid ejection failure such as a non-ejection of the liquid from any of the ejection openings can be detected with a relatively high accuracy.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENT

Hereinafter, there will be described a preferred embodiment of the present invention by reference to the drawings. It is to be understood that the following embodiment is described only by way of example, and the invention may be otherwise embodied with various modifications without departing from the scope and spirit of the invention.

General Structure of Ink-Jet Printer

Figure 1:
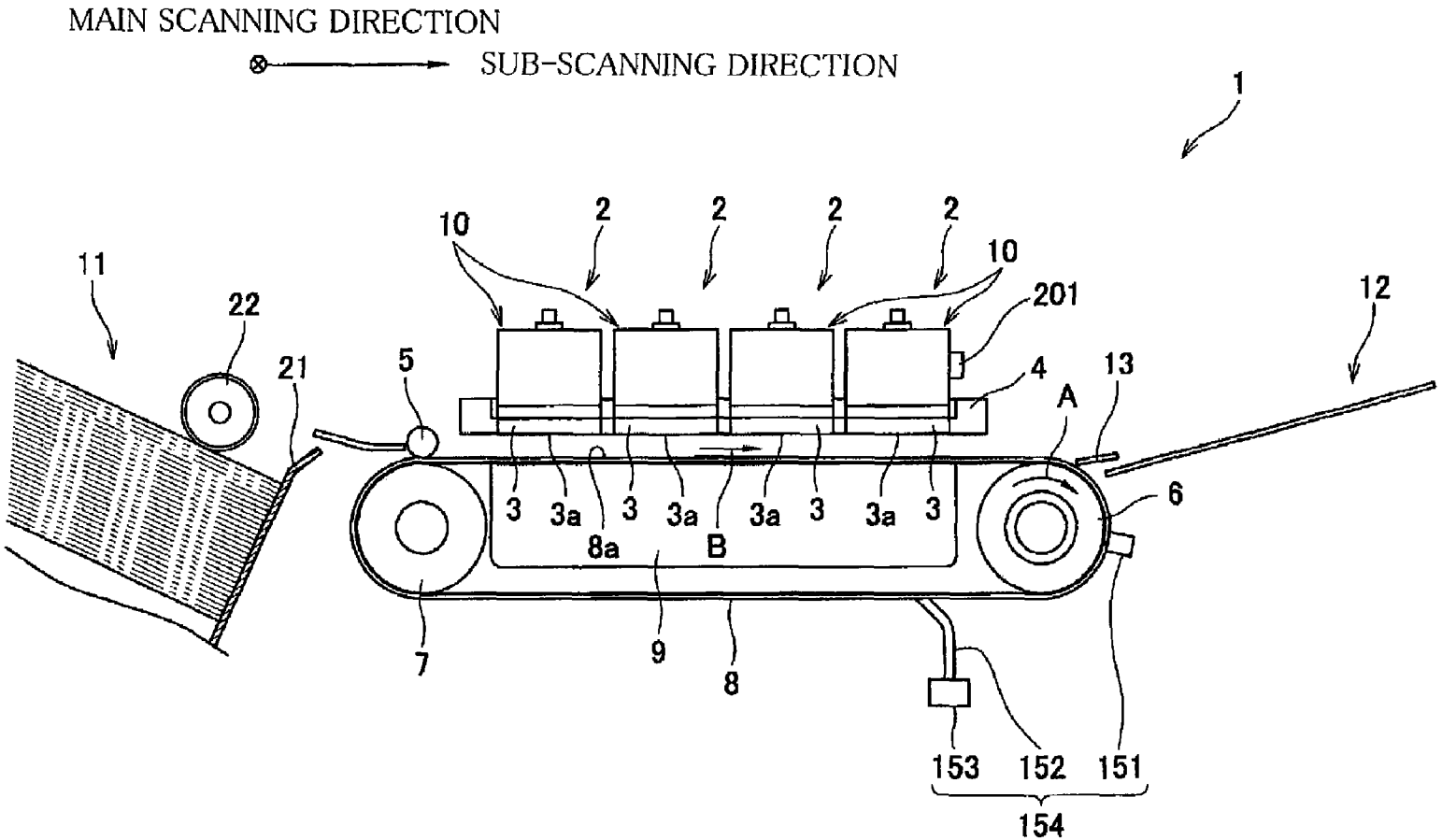
FIG. 1 is a side view of an ink-jet printer that is an image recording apparatus as an embodiment of the present invention.

FIG. 1 shows an ink-jet printer 1 that is an image recording apparatus as an embodiment of the present invention. The ink-jet printer 1 is a color ink-jet printer having ink-jet heads 2 respectively ejecting inks (liquids) of four colors, namely, magenta, cyan, yellow, and black. The ink-jet printer 1 is provided with a sheet-supply mechanism 11 located at a left portion of FIG. 1 and a sheet-discharge portion 12 located at a right portion of FIG. 1.

In the ink-jet printer 1, there is formed a sheet-convey path through which a recording sheet as a recording medium is conveyed from the sheet-supply mechanism 11 toward the sheet-discharge portion 12. The sheet-supply mechanism 11 is provided with a pickup roller 22. The pickup roller 22 is rotated by driving of a pickup motor 132 (shown in FIG. 6), whereby an uppermost one of the recording sheets in a sheet tray 21 is supplied and conveyed from the left side of FIG. 1 toward the right side of FIG. 1. At a middle portion of the sheet-convey path, a sheet-convey mechanism is disposed. The sheet-convey mechanism includes two belt rollers 6, 7 and an endless sheet-convey belt 8 wound around the belt rollers 6, 7 to bridge the belt rollers 6, 7. The endless sheet-convey belt 8 is for conveying the recording sheet.

An outer peripheral surface 8*a* of the sheet-convey belt 8 is subjected to a silicone processing to have a viscosity. Just on a downstream side of the sheet-supply mechanism 11 in a sheet-convey direction B in which the recording sheet is conveyed, a sheet-press roller 5 is disposed at a position facing the sheet-convey belt 8. The sheet-press roller 5 presses, toward the outer peripheral surface 8*a* of the sheet-convey belt 8, the recording sheet supplied from the sheet-supply mechanism 11. Thus, the recording sheet pressed toward the outer peripheral surface 8*a* is conveyed in the sheet-convey direction B while being held by the outer peripheral surface 8*a* owing to the viscosity thereof. In this conveying of the recording sheet, a drive power of a sheet-convey motor 133 (shown in FIG. 6) is applied to the belt roller 6 located downstream of the belt roller 7 in the sheet-convey direction B, whereby the belt roller 6 is rotated in a clockwise direction in FIG. 1 (i.e., a direction indicated by arrow A).

A peeling plate 13 is provided just on a downstream side of the sheet-convey belt 8 in the sheet-convey direction B along the sheet-convey path. The peeling plate 13 peels, from the outer peripheral surface 8*a*, the recording sheet held by the outer peripheral surface 8*a*. Then, the recording sheet is conveyed on the peeling plate 13 toward the sheet-discharge portion 12 located on a right side of the peeling plate 13.

A platen 9 having a generally rectangular parallelepiped shape is disposed in an area surrounded by the sheet-convey belt 8. The platen 9 is held in contact with an inner surface of an upper portion of the sheet-convey belt 8, which upper portion faces the ink-jet heads 2, whereby the platen 9 supports the sheet-convey belt 8 from an inner side thereof. Thus, as shown in FIG. 1, there is formed a space defined between an outer surface of the upper portion of the sheet-convey belt 8 and lower surfaces of the ink-jet heads 2.

At a position located on an obliquely right and lower side of the belt roller 6, there is disposed an absorber 151 which always contacts with the outer peripheral surface 8*a* of the sheet-convey belt 8. The absorber 151 has a rectangular parallelepiped shape whose longitudinal direction coincides with a direction perpendicular to a sheet surface of FIG. 1. A length of the absorber 151 in the longitudinal direction thereof is substantially the same as a width of the sheet-convey belt 8. The absorber 151 is connected to a tank (not shown) via an opening and closing valve (not shown). When the opening and closing valve is opened by a command of a controller 101 which will be described below, cleaning liquid in the tank is supplied to the absorber 151. On the other hand, when the opening and closing valve is closed by the command of the controller 101, the supply of the cleaning liquid to the absorber 151 is stopped. In this way, the absorber 151 absorbs the cleaning liquid and applies the absorbed cleaning liquid to the outer peripheral surface 8*a*.

At a position located on a downstream side of the absorber 151 in a direction in which the sheet-convey belt 8 is circulated (that is, on an upstream side of the belt roller 6 and a downstream side of the belt roller 7 which is located just on an upstream side of the ink-jet heads 2) and on an obliquely left and lower side of the belt roller 6 in FIG. 1, there is disposed a blade 152 such that a distal end of the blade 152 always contacts with the outer peripheral surface 8*a*. The blade 152 scrapes or wipes, by the distal end thereof, the cleaning liquid and the inks adhering to the outer peripheral surface 8*a*. The cleaning liquid and the like scraped by the blade 152 are discarded into a discarding portion 153 provided under the blade 152. In this way, the absorber 151, the blade 152, and the discarding portion 153 constitutes a cleaning device 154 for cleaning the outer peripheral surface 8*a* of the sheet-convey belt 8.

Figure 2:
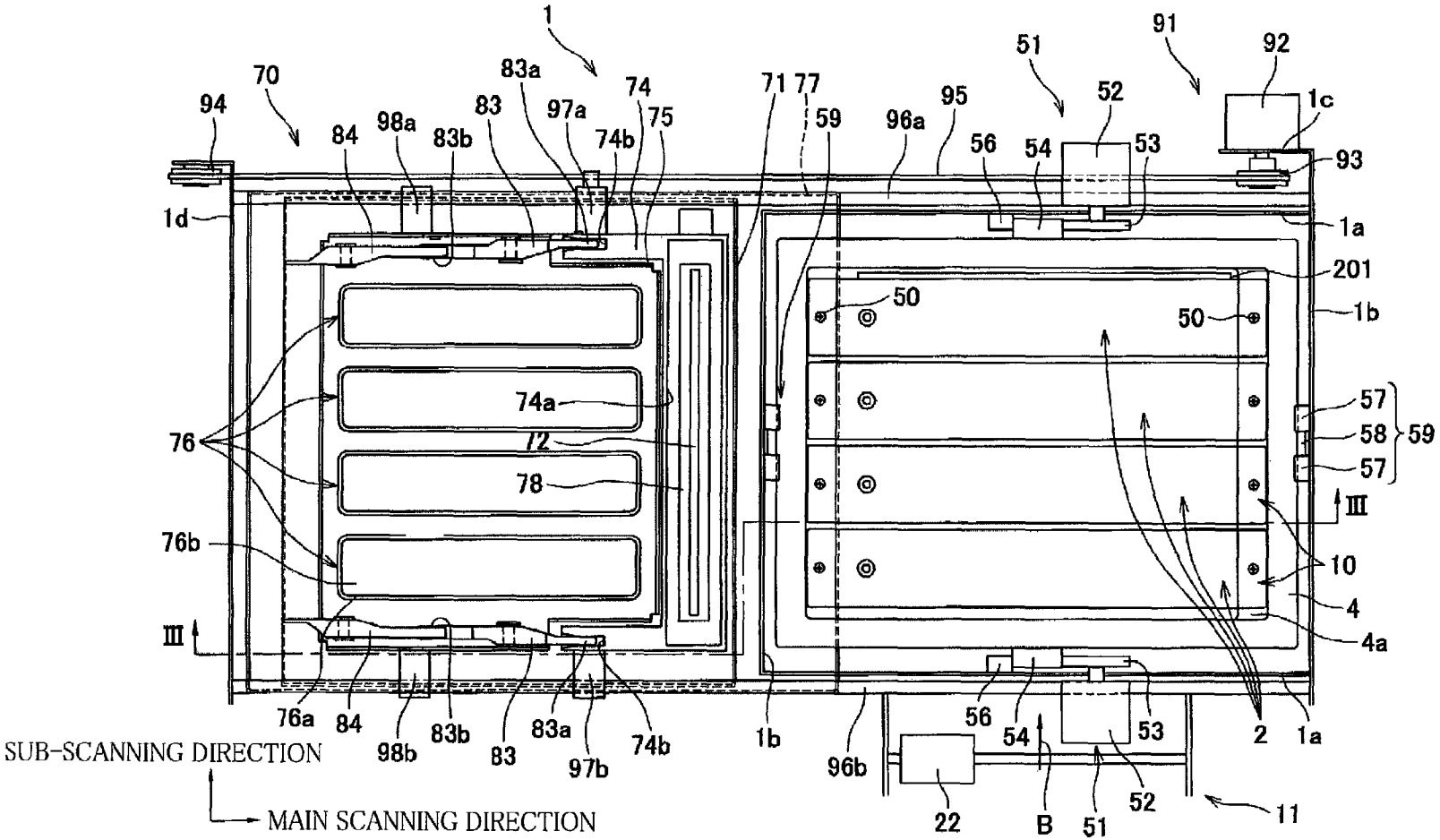
FIG. 2 is a plan view partially showing the ink-jet printer.
Figure 3:
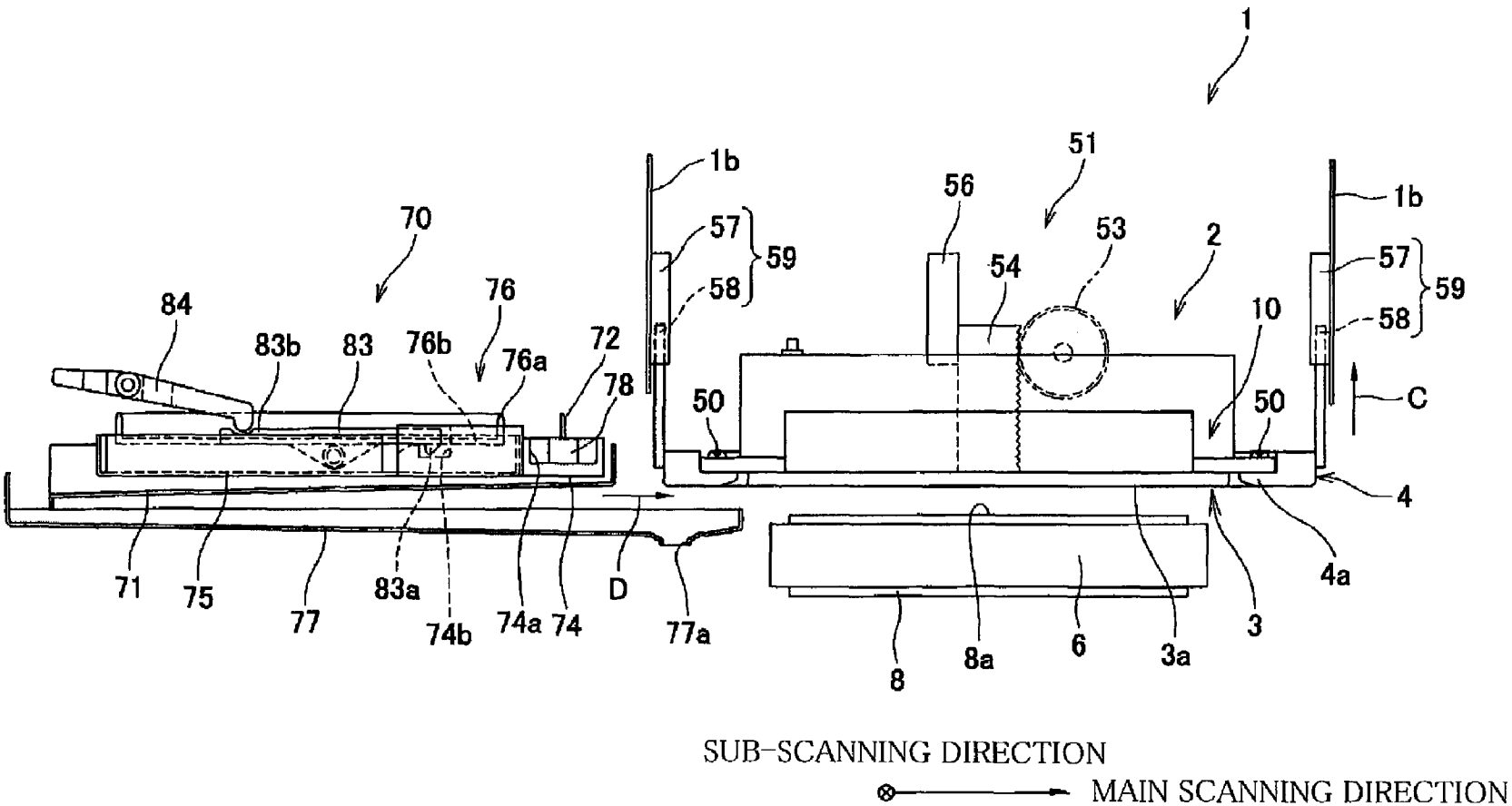
FIG. 3 is a cross-sectional view taken along a line III-III in FIG. 2.

As shown in FIG. 2, each of the four ink-jet heads 2 extends in a main scanning direction which is perpendicular to the sheet surface of FIG. 1. The ink-jet heads 2 are arranged in a sub-scanning direction which is perpendicular to the main scanning direction and coincides with the sheet-convey direction B. That is, the ink-jet printer 1 is of a line-type. As shown in FIGS. 1 and 3, each of the ink-jet heads 2 has, at a lower end thereof, a corresponding one of head bodies 3. Each of the head bodies 3 includes an ink channel unit and an actuator fixed to each other. The ink channel unit includes a plurality of individual ink channels including pressure chambers, and the actuator applies the inks in the pressure chambers. Each head body has a rectangular parallelepiped shape elongated in the main scanning direction. In a lower surface of each head body 3, that is, an ejection surface 3*a* of each head body 3, there are provided and arranged a large number of ejection openings 3*b* (shown in FIG. 4) which are fine openings each for ejecting the inks and each as one end of a corresponding one of nozzles.

As shown in FIGS. 1 and 3, reservoir units 10 for temporarily storing the respective inks are fixed to respective upper surfaces of the head bodies 3. Each of the reservoir units 10 is longer than a corresponding one of the head bodies 3 and projected from opposite ends of the corresponding head body 3 in a longitudinal direction thereof. The reservoir units 10 are fixed, at the projected portions thereof, to a frame 4 having a rectangular opening such that the ejection surfaces 3*a* can be seen through the opening from a lower side of the ejection surfaces 3*a*. More specifically, a pair of flanges 4*a* each of which supports a corresponding one of opposite ends of the reservoir units 10 from lower sides thereof are projected from respective opposite end portions of the frame 4 toward a middle portion of the opening in a longitudinal direction thereof. The flanges 4*a* and longitudinal end portions of each reservoir unit 10 are fixed to each other by screws 50. The ejection surfaces 3*a* are the same in height as a bottom surface of the frame 4.

The head bodies 3 are disposed such that the ejection surfaces 3*a* face and are parallel to a portion of the sheet-convey belt 8 which is supported by the platen 9 and such that the small space or clearance is formed between the ejection surface 3*a* and the sheet-convey belt 8. The small space constitutes a part of the sheet-convey path. When the recording sheet is conveyed on the outer peripheral surface 8*a* just under the four head bodies 3 in order, the inks of the four colors are ejected toward an upper surface or a print surface of the conveyed recording sheet, whereby a desired color image is recorded on the recording sheet.

In this ink-jet printer 1, an image sensor 201 is attached to a downstream side face of one of the ink-jet heads 2 which is located at the most downstream position. A detailed explanation of the image sensor 201 will be described below.

Raising and Lowering Mechanisms

As shown in FIGS. 2 and 3, the frame 4 is supported by a pair of raising and lowering mechanisms 51 provided in the ink-jet printer 1, so as to be movable in a vertical direction. The pair of raising and lowering mechanisms 51 are disposed on both sides of the four ink-jet heads 2 in the sub-scanning direction. Each of the raising and lowering mechanisms 51 includes a head motor 52 as a drive source for moving the frame 4 in the vertical direction, a pinion gear 53 fixed to a shaft of the head motors 52, a rack gear 54 meshed with the pinion gear 53, and a guide 56 disposed at a position at which the rack gear 54 is interposed between the pinion gears 53 and the guide 56. As will be described below, the raising and lowering mechanisms 51 are driven on the basis of a control of the controller 101.

The head motors 52 included in the respective raising and lowering mechanisms 51 are respectively fixed to a pair of body frames 1*a* of the ink-jet printer 1. The pair of body frames 1*a* are disposed so as to face each other in the sub-scanning direction. The rack gears 54 extend in the vertical direction and are fixed, at lower ends thereof, to respective opposed side faces of the frame 4. Each of the rack gears 54 slidably contacts with a corresponding one of the guides 56 at one of opposed side faces of each rack gear 54, which one is opposite to the other that is mashed with a corresponding one of the pinion gear 53. The guides 56 are fixed to the respective body frames 1*a*.

When the pinion gears 53 are rotated forwardly or reversely with the two head motors 52 synchronized with each other, the rack gears 54 are moved upward or downward. With the movement of the rack gears 54, the frame 4 is moved upward and downward in the vertical direction together with the four ink-jet heads 2.

A pair of guide units 59 are disposed on respective opposed side faces of the frame 4 which extend in the sub-scanning direction. Each of the guide units 59 includes a bar 58 and a pair of guides 57 between which the bar 58 is interposed. As shown in FIG. 3, the two pairs of guides 57 extend in the vertical direction, and each of the pairs is fixed to a corresponding one of a pair of body frames 1*b* of the ink-jet printer 1. The pair of body frames 1*b* are disposed so as to face each other in the main scanning direction. The bars 58 extend in the vertical direction like the guides 57 and are respectively fixed to the side faces of the frame 4 which respectively face the body frames 1*b*. Each of the bar 58 is slidably contacted with a corresponding pair of the guides 57.

The guide units 59 prevent the ejection surfaces 3*a* from inclining with respect to the portion of the sheet-convey belt 8 which is supported by the platen 9, when the frame 4 is move upward and downward in the vertical direction by the raising and lowering mechanisms 51. That is, even when the frame 4 and the ink-jet heads 2 are moved upward and downward in the vertical direction by the raising and lowering mechanisms 51, the ejection surfaces 3*a* are always parallel to an upper surface of the platen 9. As a result, an ejected-ink-attaching accuracy upon recording can be improved.

Normally, the frame 4 is disposed at a recording position (where the frame 4 is located in FIG. 3) at which the ink-jet heads 2 eject the inks onto the recording sheet for the recording, by being moved by the raising and lowering mechanisms 51 in a direction indicated by arrow C in FIG. 3. Only when the ink-jet heads 2 are subjected to a maintenance operation such as a purging operation in which the inks are forced to be ejected from the ink-jet heads 2, a wiping operation in which the inks adhering to the ejection surfaces 3*a* are wiped, and a covering operation in which the ejection surfaces 3*a* are covered or capped by caps, the frame 4 is moved in the direction indicated by the arrow C in FIG. 3 by the raising and lowering mechanisms 51, so as to be disposed at a maintenance position at which the four ink-jet heads 2 are above the height level of the recording position.

In view of the above, the raising and lowering mechanisms 51 are for positioning the ink-jet heads 2 at a selected one of a plurality of heights.

Image Sensor

Figure 4:
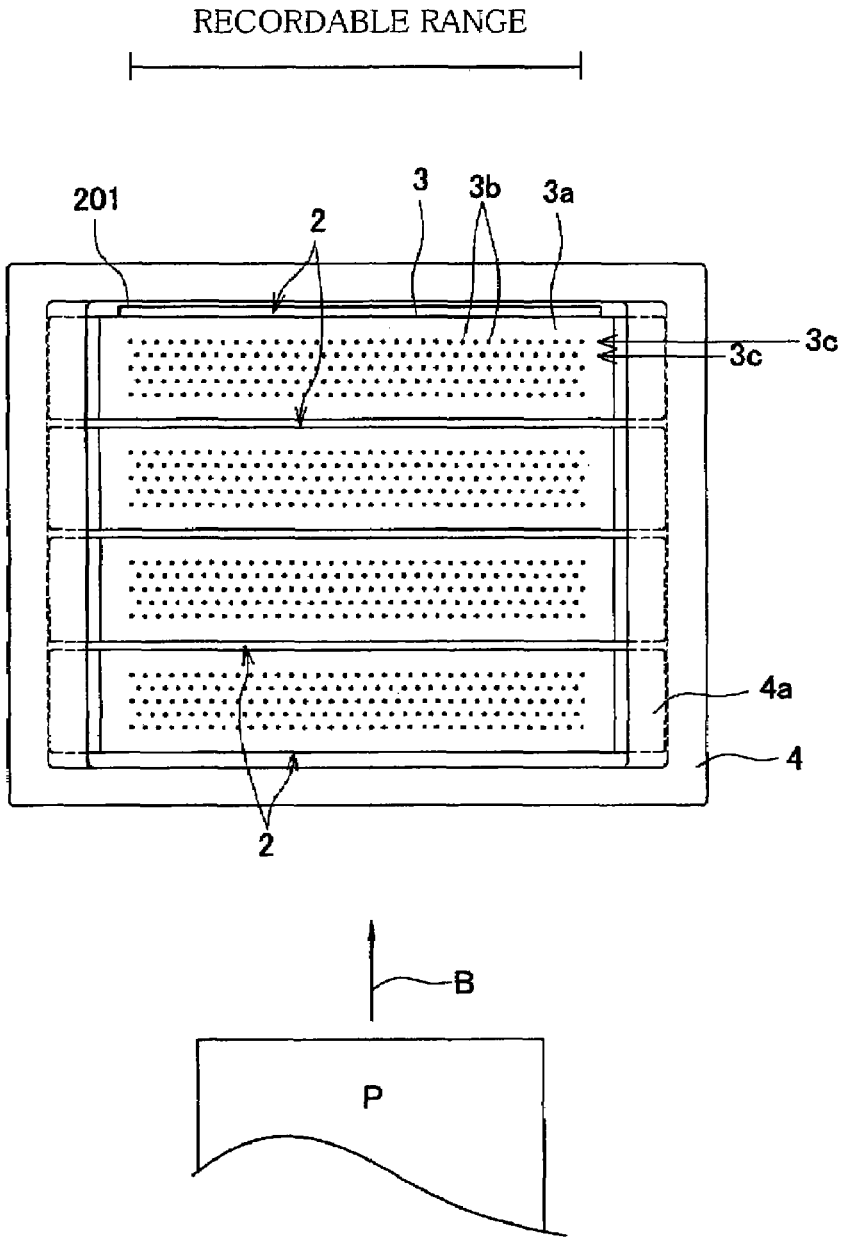
FIG. 4 is a bottom view showing four ink-jet heads of the ink-jet printer.

Here, there will be explained, with reference to FIG. 4, a positional relationship among the ink-jet heads 2, the image sensor 201, and the recording sheet. As shown in FIG. 4, the plurality of ejection openings 3*b* which are the fine openings each as the one end of the nozzle are formed in the ejection surfaces 3*a*. In the ejection surfaces 3*a*, there are formed a plurality of nozzle rows (ejection openings rows) 3*c* each of which is constituted by ones of the ejection openings 3*b* that are arranged so as to be equally spaced from each other in the main scanning direction. The plurality of nozzle rows 3*c* are parallel to each other. Any of the ejection openings 3*b* formed in each of the ink-jet heads 2 is not located at the same positions as the other of the ejection openings 3*b* in the main scanning direction. The ejection openings 3*b* formed in each ink-jet head 2 are arranged so as to be equally spaced from each other in the main scanning direction.

The image sensor 201 is attached to the downstream side face of the one of the ink-jet heads 2 which is located at the most downstream position in the sub-scanning direction. That is, the image sensor 201 is integral with the one of the ink-jet heads 2. Thus, the image sensor 201 is movable by the driving of the raising and lowering mechanisms 51 together with the four ink-jet heads 2 and the frame 4. The image sensor 201 is disposed so as to be corresponded to a space formed between the frame 4 and the one of the ink-jet heads 2 which is located at the most downstream position in the sub-scanning direction. Thus, a lower surface of the image sensor 201 faces the outer peripheral surface 8*a* of the sheet-convey belt 8 without being intercepted by the frame 4.

The image sensor 201 has an image-pickup range in which the image sensor can pick up an image. The image-pickup range is equal to or slightly larger than, in the main scanning direction, an image-recordable range of the ink-jet heads 2 in which the ink-jet heads 2 can record the image on the recording sheet. That is, the image sensor 201 is of a line type. In contrast, a width of a recording sheet P conveyed through the sheet-convey path (i.e., a length of the recording sheet P in the main scanning direction) is somewhat smaller than the image-recordable range of the ink-jet heads 2. Accordingly, even when the recording sheet P is conveyed in a state in which the recording sheet P is slightly shifted in a widthwise direction thereof, the image sensor 201 can pick up the image recorded on the recording sheet P in its full width. As will be described below, the image sensor 201 is used for picking up a test image recorded on the outer peripheral surface 8*a* (or on the recording sheet).

Figure 5:
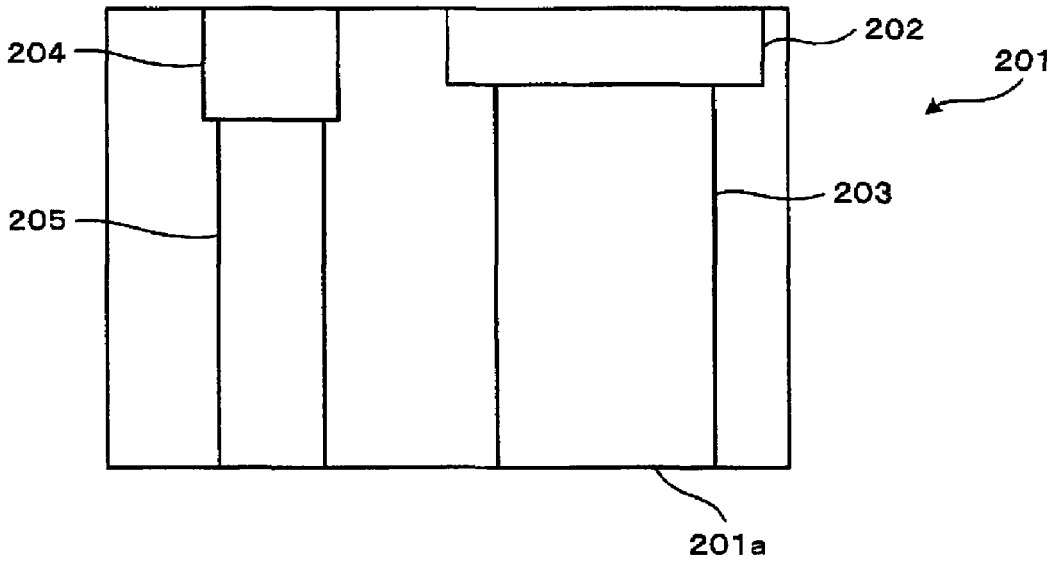
FIG. 5 is a cross-sectional view schematically showing an image sensor of the ink-jet printer.

As shown in FIG. 5, the image sensor 201 includes an image-pickup element 202, an image-forming optical system 203, an LED (a light-emitting diode) 204, and a light guide 205. The image-pickup element 202 is provided by a CCD or a CMOS, for example. The image-forming optical system 203 is provided between the image-pickup element 202 and a light-entering surface 201*a* as a lower surface of the image sensor 201 which faces the outer peripheral surface 8*a* of the sheet-convey belt 8. The image-forming optical system 203 guides, to the image-pickup element 202, a light entered through the light-entering surface 201*a* and is for forming, on the image-pickup element 202, an optical image of an object (in this ink-jet printer 1, the image recorded on the outer peripheral surface 8*a* of the sheet-convey belt 8). The LED 204 is a source of light with which the object is irradiated. The light guide 205 guides the light emitted from the LED 204 such that the light is emitted from the light-entering surface 201*a* toward the object. Each of the image-pickup element 202, the image-forming optical system 203, the LED 204, and the light guide 205 extends in the main scanning direction.

Structure of Maintenance Unit

There will be explained, with reference to FIGS. 2 and 3, a maintenance unit 70 for performing the maintenance operation for the ink-jet heads 2. As shown in the figures, the maintenance unit 70 is disposed in a left side of the ink-jet heads 2. The maintenance unit 70 includes two trays 71, 75 movable horizontally. The tray 71 has a generally square box-like shape having an opening opened upward. The tray 71 encloses the tray 75. In other words, the tray 75 is in the tray 71. The tray 71 and the tray 75 are connectable to and disconnectable from each other. A state in which the tray 71 and the tray 75 are connected to each other and a state in which the tray 71 and the tray 75 are disconnected from each other are changeable on the basis of whether recessed portions 74*b* and projecting portions 83*a* which will be described below are engaged with each other or disengaged from each other.

When the maintenance unit 70 is horizontally moved toward a right side thereof, the frame 4 is moved upward to the maintenance position in advance in the direction indicated by the arrow C in FIG. 3, so that the space for the maintenance unit 70 is assured between the four ejection surfaces 3*a* and the sheet-convey belt 8. Thereafter, the maintenance unit 70 is horizontally moved in a direction indicated by arrow D in FIG. 3. One of side faces of the tray 71 which is further from the ink-jet heads 2 is opened, so that when the recessed portions 74*b* and the projecting portions 83*a* are disengaged from each other (in the purging operation, for example), only the tray 71 is horizontally moved rightward with the enclosed tray 75 remaining at its original position.

A waste-ink receiving tray 77 is disposed just below the maintenance unit 70. The waste-ink receiving tray 77 has a size enclosing the tray 71 in plan view. Even when the tray 71 is moved to an right end of the ink-jet printer 1 in FIG. 2, the waste-ink receiving tray 77 overlaps with one of opposite end portions of the tray 71, which one is located on an opposite side of the ink-jet heads 2. An ink-discharge opening 77*a* is formed in one of opposite end portions of the waste-ink receiving tray 77 which one is nearer to the ink-jet heads 2. The ink-discharge opening 77*a* guides or discharges, to a waste-ink accumulating portion (not shown), the ink flown onto the waste-ink receiving tray 77.

A wiper 72 and the tray 75 are disposed in the tray 71 with the wiper 72 located nearer to the ink-jet heads 2 than the tray 75. In the tray 75, four caps 76 each having a rectangular shape in plan view are arranged side by side in correspondence with the respective ink-jet heads 2. A longitudinal direction of the caps 76 is parallel to a longitudinal direction of the ink-jet heads 2. The caps 76 are disposed in the sub-scanning direction with pitches which are the same as pitches with which the ink-jet heads 2 are disposed in the sub-scanning direction.

Each of the caps 76 includes a plate-like member 76*b* and a circular projection 76*a*. Each plate-like member 76*b* has, in plan view, a rectangular shape which is substantially the same size as a corresponding one of the ejection surfaces 3*a*, and each circular projection 76*a* projects upward from a peripheral portion of a corresponding one of the plate-like members 76*b*. Each circular projection 76*a* is formed of an elastic material such as rubber and has a size and a shape in which each circular projection 76*a* faces a peripheral portion of a corresponding one of the ejection surfaces 3*a*. Each cap 76 defines an air-tight space when the corresponding circular projection 76*a* contacts with the peripheral portion of the corresponding ejection surface 3*a*. In this manner, each cap 76 can cover the corresponding ejection surface 3*a*. The caps 76 are forced upward by two springs (not shown) while being supported by a bottom surface of the tray 75.

To the tray 71, there are fixed, in addition to the wiper 72, a holding member 74 on which a mount member 78 is disposed. The holding member 74 has a three-sided rectangular shape in plan view. A groove 74*a* extending in the sub-scanning direction is formed in an upper surface of a portion of the holding member 74 which extends in the sub-scanning direction. In the groove 74*a*, the mount member 78 and the wiper 72 are disposed. The above-described recessed portions 74*b* are respectively formed in respective upper surfaces of two portions of the holding member 74 which extend in the main scanning direction.

The wiper 72 is formed of an elastic material such as rubber. The wiper 72 has a length slightly larger than an entire width of the four ink-jet heads 2 in the sub-scanning direction and is fixed to the mount member 78 such that a longitudinal direction of the wiper 72 coincides with the sub-scanning direction. The mount member 78 has a rectangular parallelepiped shape which extends in the sub-scanning direction like the wiper 72.

The recessed portions 74*b* and hooking members 83 are respectively provided near opposite ends of the trays 71, 75. Each of the hooking members 83 extends in the main scanning direction and is pivotable about a central portion thereof. Each of the projecting portions 83*a* is provided on one of opposite end portions of a corresponding one of the hooking members 83, which one is nearer to the ink-jet heads 2. When the hooking members 83 are pivoted in a clockwise direction in FIG. 3, the projecting portions 83*a* are respectively engaged with the recessed portions 74*b*. Above the maintenance unit 70, contacting members 84 are disposed in correspondence with the respective two hooking members 83. The state in which the tray 71 and the tray 75 are connected to each other and the state in which the tray 71 and the tray 75 are disconnected from each other are changeable on the basis of whether recessed portions 74*b* and projecting portions 83*a* which will be described below are engaged with each other or disengaged from each other.

The contacting members 84 are supported so as to be pivotable. When each of the contacting members 84 is pivoted in the clockwise direction in FIG. 3, one of opposite ends of each contacting member 84 is brought into contact with the other end portion 83*b* of a corresponding one of the hooking members 83. When the contacting members 84 are further pivoted in the clockwise direction in FIG. 3, the hooking members 83 are pivoted in a counterclockwise direction in FIG. 3, whereby the projecting portions 83*a* and the respective recessed portions 74*b* are disengaged from each other. On the other hand, when the contacting members 84 are pivoted in the counterclockwise direction in FIG. 3 to move away from the other end portions 83*b*, the projecting portions 83*a* and the respective recessed portions 74*b* are engaged with each other by own weights of the respective hooking members 83.

When the maintenance operation of the ink-jet heads 2 is not performed, the maintenance unit 70 is, as show in FIGS. 2 and 3, at rest at a retracted position at which the maintenance unit 70 does not face the ink-jet heads 2. When the maintenance operation is performed, the maintenance unit 70 is horizontally moved from the retracted position to a maintenance position at which the maintenance unit 70 faces the ejection surfaces 3*a* of the respective ink-jet heads 2. In this movement, distal ends of the wiper 72 and the caps 76 are not brought into contact with the ejection surfaces 3*a* because the frame 4 is disposed at the maintenance position.

It is noted that even when the maintenance operation is performed, only the tray 71 is moved, in the purging operation, from the retracted position to the maintenance position to receive the discharged inks, with the tray 75 remaining at its original position. When the ejection surfaces 3*a* are covered by the respective caps 76, the tray 71 and the tray 75 are connected to each other by the engagement of the recessed portions 74*b* and the respective projecting portions 83*a*, thereby moving the maintenance unit 70 to a position at which the caps 76 and the ejection surface 3*a* are respectively face each other.

The trays 71, 75 are slidably supported by a pair of guide shafts 96*a*, 96*b* extending in the main scanning direction. Two bearing members 97*a*, 97*b* are provided on the tray 71. The bearing members 97*a*, 97*b* are projected from respective opposed outside faces of the holding member 74. Two bearing members 98*a*, 98*b* are provided on the tray 75. The bearing members 98*a*, 98*b* are projected from respective opposite side faces of the tray 75. Each of the pair of guide shafts 96*a*, 96*b* is fixed, at opposite ends thereof, to the body frames 1*b*, 1*d*. The pair of guide shafts 96*a*, 96*b* are disposed between the body frames 1*b*, 1*d* so as to be parallel to each other.

Here, there will be explained a horizontally moving mechanism 91 for horizontally moving the trays 71, 75 along the guide shafts 96*a*, 96*b* in the direction indicated by the arrow D. As shown in FIG. 2, the horizontally moving mechanism 91 includes a tray motor 92, a motor pulley 93, an idle pulley 94, a timing belt 95, the guide shafts 96*a*, 96*b*, and so on.

The tray motor 92 is fixed to a mount portion 1*c* formed at one of end portions of the body frames 1*b* extending in the sub-scanning direction. The motor pulley 93 is connected to the tray motor 92, and rotated in accordance with driving of the tray motor 92. The idle pulley 94 is rotatably supported by a body frame 1*d* located at the most left side of the ink-jet printer 1 in FIG. 2. The timing belt 95 is disposed so as to be parallel to the guide shaft 96*a* and wound around the motor pulley 93 and the idle pulley 94 to bridge the motor pulley 93 and the idle pulley 94. The timing belt 95 is connected to the bearing member 97*a* provided on the holding member 74.

In this construction, when the tray motor 92 is driven, the timing belt 95 is moved in accordance with forward and reverse rotations of the motor pulley 93. By the movement of the timing belt 95, the tray 71 connected to the timing belt 95 via the bearing member 97*a* is horizontally moved. In a state in which the recessed portions 74*b* and the projecting portions 83*a* are respectively engaged with each other, the wiper 72 in the tray 71 and the caps 76 in the tray 75 are moved together with each other. On the other hand, in a state in which the projecting portions 83*a* and the recessed portions 74*b* are not engaged with each other, only the wiper 72 in the tray 71 is moved.

Controlling System

Figure 6:
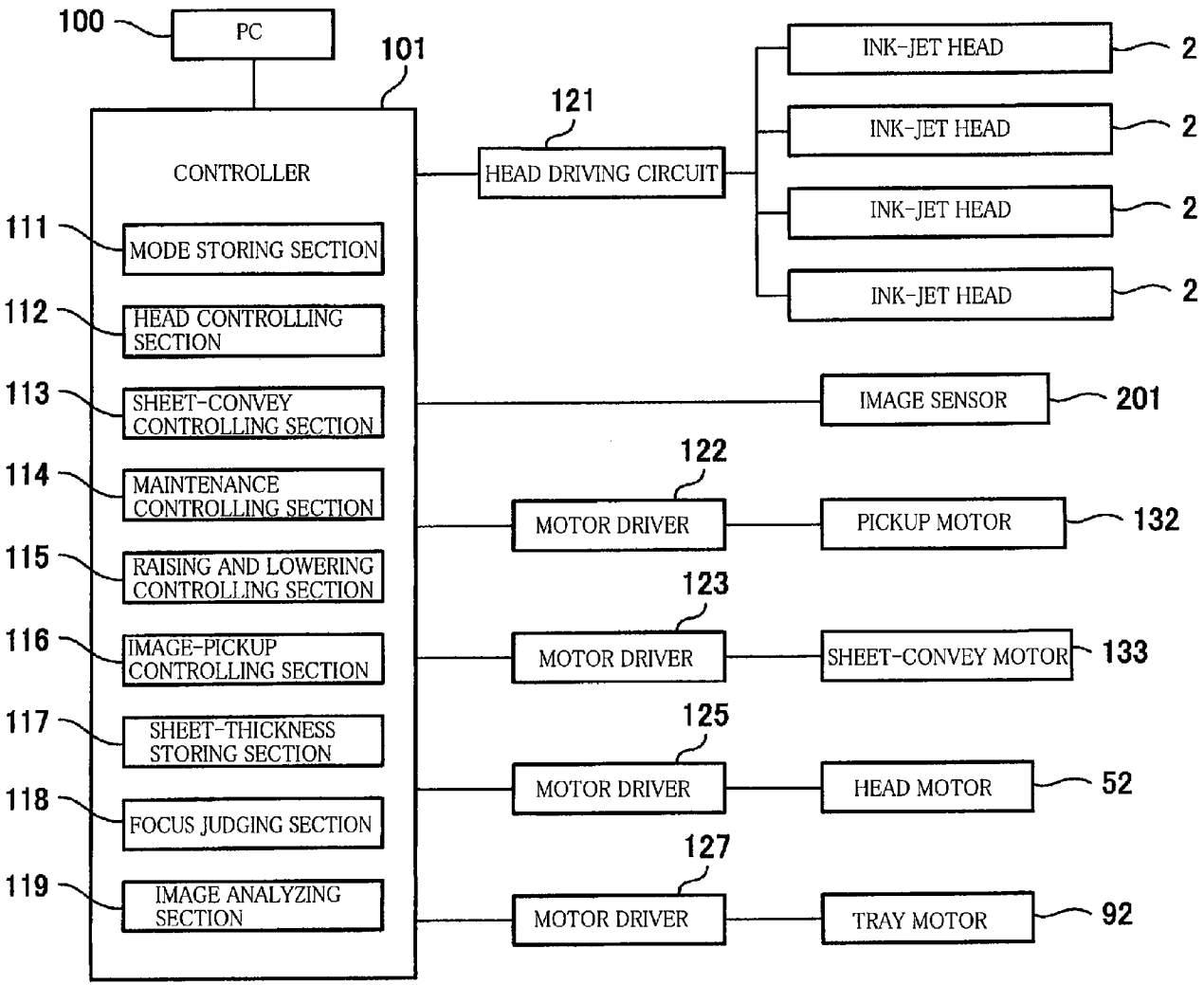
FIG. 6 is a block diagram showing the ink-jet printer.

There will be next explained a controlling system of the ink-jet printer 1 with reference to FIG. 6. The ink-jet printer 1 includes the controller 101 configured to execute controls for operations of the ink-jet printer 1. The controller 101 includes a Central Processing Unit (CPU), a Read Only Memory (ROM), and a Random Access Memory (RAM). The CPU functions as an arithmetic processing unit, the ROM stores controlling programs executed by the CPU and data used for the controlling programs, and the RAM is for temporarily storing data when the programs are executed. The CPU, the ROM, and the RAM function as a mode storing section 111, a head controlling section 112, a sheet-convey controlling section 113, a maintenance controlling section 114, a raising and lowering controlling section 115, an image-pickup controlling section 116, a sheet-thickness storing section 117, a focus judging section 118, an image analyzing section 119, and so on.

The mode storing section 111 stores whether the ink-jet printer 1 is in a normal recording mode or an inspecting mode, and indicates, as a mode indicating section, one of the normal recording mode and the inspecting mode. Here, the normal recording mode is a mode in which a desired image is recorded on the recording sheet, and the inspecting mode is a mode which is for inspecting the ink-jet heads 2 and in which the test image is recorded on the outer peripheral surface 8*a* of the sheet-convey belt 8. A content stored in the mode storing section 111 is changed by a signal transmitted from a personal computer (PC) 100 on the basis of an operation of a user. As a modification, there may be provided, instead of the mode storing section 111, an analog circuit in which a level of an outputted signal varies in accordance with whether the ink-jet printer 1 is in the normal recording mode or the inspecting mode. In short, a means or the like which indicates whether the ink-jet printer 1 is in the normal recording mode or the inspecting mode needs only to be provided.

When the ink-jet printer 1 is in the normal recording mode, the head controlling section 112 controls a head driving circuit 121 such that the inks are ejected, on the basis of a recording data received from the PC 100, by one or ones of the ink-jet heads 2 which is or are corresponded to the received recording data. When the ink-jet printer 1 is in the inspecting mode, the head controlling section 112 controls the head driving circuit 121 such that the test image is recorded on the outer peripheral surface 8*a* of the sheet-convey belt 8. Here, image data relating to the test image may be data that is received from the PC 100, or may be data that is stored in the ROM of the ink-jet printer 1.

When the ink-jet printer 1 is in the normal recording mode, the sheet-convey controlling section 113 controls a motor driver 122 such that the uppermost one of the recording sheets in the sheet tray 21 is conveyed onto the sheet-convey belt 8 by rotating of the pickup roller 22 which is caused by driving of the pickup motor 132, and controls a motor driver 123 such that the recording sheet is conveyed while being held on the outer peripheral surface 8*a* by the rotating of the belt roller 6 which is caused by driving of the sheet-convey motor 133. Further, the sheet-convey controlling section 113 controls the motor driver 123 such that the rotation of the belt roller 6 is stopped by stopping the driving of the sheet-convey motor 133 after the recording sheet on the sheet-convey belt 8 has reached the sheet-discharge portion 12. Furthermore, the sheet-convey controlling section 113 controls the motor driver 123 which drives the sheet-convey motor 133, such that, when the ink-jet printer 1 is in the inspecting mode, the belt roller 6 is rotated in a state in which the recording sheet is not held on the outer peripheral surface 8*a*.

The maintenance controlling section 114 controls the maintenance unit 70. Specifically, the maintenance controlling section 114 controls a motor driver 127 such that the tray 71 is horizontally moved from the retracted position to the maintenance position by the driving of the tray motor 92 when the inks are initially introduced into the ink-jet heads 2, and when the purging operation is performed. Further, the maintenance controlling section 114 controls the motor driver 127 such that the tray 71 is horizontally moved from the maintenance position to the retracted position by the driving of the tray motor 92 when the purging operation is finished. Furthermore, the maintenance controlling section 114 controls the motor driver 127 such that the trays 71, 75 are horizontally moved from the retracted positions to their capping positions by the driving of the tray motor 92 when the ejection surfaces 3*a* are covered or capped. Furthermore, the maintenance controlling section 114 controls the motor driver 127 such that the trays 71, 75 are horizontally moved from the capping positions to the retracted positions by the driving of the tray motor 92 when the recording data has been received from the PC 100. Furthermore, the maintenance controlling section 114 controls a pump driver (not shown) such that the inks in respective ink cartridges (not shown) are forced to be respectively sent to the head bodies 3 by pumps (not shown) when the inks are initially introduced into the ink-jet heads 2, and when the purging operation is performed.

The raising and lowering controlling section 115 changes a height of the frame 4 and the four ink-jet heads 2 by controlling the raising and lowering mechanisms 51. Specifically, the raising and lowering controlling section 115 controls a motor driver 125 which is a portion of the raising and lowering mechanisms 51 and which drives the head motors 52 shown in FIG. 2. In the normal recording mode, the raising and lowering controlling section 115 controls the motor driver 125 such that the frame 4 is located at the maintenance position when the inks are initially introduced into the ink-jet heads 2, and when the maintenance operation of the ink-jet heads 2 is performed. Further, in the normal recording mode, the raising and lowering controlling section 115 controls the motor driver 125 such that the frame 4 is located at the recording position when the image is recorded on the recording sheet. Furthermore, in the inspecting mode, the raising and lowering controlling section 115 controls the motor driver 125 such that the frame 4 is located at an inspecting position which is lower in height than the recording position.

Figure 7A:
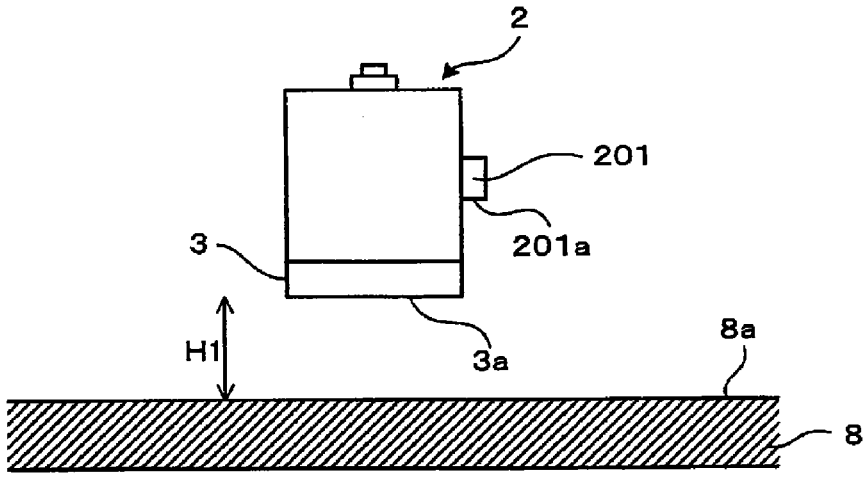
FIGS. 7A and 7B are side views each schematically showing one of the ink-jet heads and the image sensor.

FIG. 7A is a side view schematically showing the image sensor 201 and the one of the ink-jet heads 2 which is located at the most downstream position, when the frame 4 is located at the inspecting position. As shown in FIG. 7A, a distance from the outer peripheral surface 8*a* of the sheet-convey belt 8 to the ejection surfaces 3*a* of the respective ink-jet heads 2 is defined as a distance H1 (hereinafter, may be referred to as a first height of the ink-jet head 2). The distance H1 is predetermined such that an optical image of the test image recorded on the outer peripheral surface 8*a* is formed on the image-pickup element 202 by the image-forming optical system 203 of the image sensor 201. That is, the distance H1 is predetermined such that an image based on image data obtained when the image sensor 201 picks up the test image recorded on the outer peripheral surface 8*a* is a focused image. In other words, the first height is a height at which the ejection surfaces 3*a* are distant from the outer peripheral surface 8*a*, and the optical image of the test image recorded on the outer peripheral surface 8*a* is formed on the image-pickup element 202 by the image-forming optical system 203.

Figure 7B:
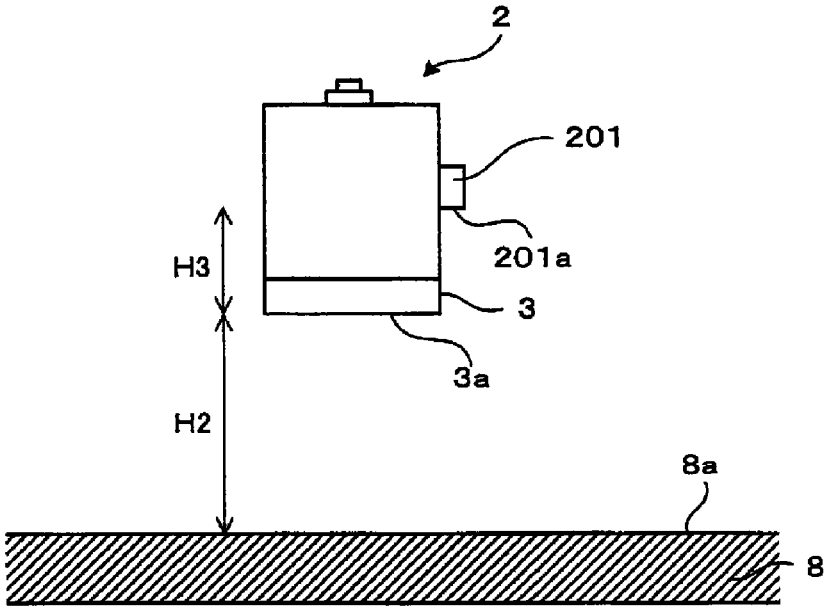

FIG. 7B is a side view schematically showing the image sensor 201 and the one of the ink-jet heads 2 which is located at the most downstream position, when the frame 4 is located at the recording position. As shown in FIG. 7B, a distance from the outer peripheral surface 8*a* of the sheet-convey belt 8 to the ejection surfaces 3*a* of the respective ink-jet heads 2 is defined as a distance H2 (hereinafter, may be referred to as a second height of the ink-jet head 2). A distance from the ejection surface 3*a* to the light-entering surface 201*a* is defined as a distance H3. The distance H2 is longer than the distance H1. In other words, the second height is a height at which the ejection surfaces 3*a* are more distant from the outer peripheral surface 8*a* than at the first height. The optical image of the test image recorded on the outer peripheral surface 8*a* is not formed on the image-pickup element 202 by the image-forming optical system 203 of the image sensor 201. That is, a focal length of the image-forming optical system 203 is shorter than the sum of the distance H2 and the distance H3 (the distance H2+the distance H3), and thus the sum of the distance H2 and the distance H3 is deviated from a range of a focal depth of the image-forming optical system 203.

In view of the above, the raising and lowering controlling section 115 is configured to control the raising and lowering mechanisms 51 such that the ink-jet heads 2 are positioned at the second height when the ink-jet printer 1 is in the normal recording mode, that is, the mode storing section indicates the normal recording mode, and such that the ink-jet heads 2 are positioned at the first height when the ink-jet printer 1 is in the inspecting mode, that is, the mode storing section indicates the inspecting mode.

In this ink-jet printer 1, the raising and lowering controlling section 115 further makes fine adjustments of the first height and the second height, the detail explanation of which will be described later.

The image-pickup controlling section 116 controls the image sensor 201 such that the image sensor 201 picks up the test image recorded on the outer peripheral surface 8*a* of the sheet-convey belt 8 when the ink-jet heads 2 are located at the first height. Image data obtained by this image-pickup operation of the image sensor 201 is analyzed by the image analyzing section 119. The test image recorded on the outer peripheral surface 8*a* is speedily cleaned or removed by the cleaning device 154.

The sheet-thickness storing section 117 stores thicknesses of various types of the recording sheets conveyed by the sheet-convey belt 8, and indicates the thickness as a medium-thickness indicating section. As a modification, there may be provided, instead of the sheet-thickness storing section 117, an analog circuit in which a level of an outputted signal varies in accordance with the thickness of the recording sheet. In short, a means or the like which indicates the thickness of the recording sheet needs only to be provided. When the mode storing section 111 stores that the ink-jet printer 1 is in the normal recording mode, the raising and lowering controlling section 115 controls the raising and lowering mechanisms 51 such that the clearance or the space between the ejection surfaces 3*a* and the recording sheet takes a predetermined value on the basis of the thickness of the recording sheet which is stored in or indicated by the sheet-thickness storing section 117, thereby making the fine adjustment of the second height. Thus, when a relatively thick recording sheet such as an envelope and a thick paper is used, the ink-jet heads 2 are moved upward in recording, thereby leading to less occurrence of jamming of the recording sheet.

The focus judging section 118 judges whether the image based on the image data obtained by the image sensor 201 is an unfocused image or not. When the focus judging section 118 has judged that the image based on the image data obtained by the image sensor 201 is the unfocused image, the raising and lowering controlling section 115 controls the raising and lowering mechanisms 51 to make the fine adjustment of the first height of the ink-jet heads 2 such that the image based on the image data obtained by the image sensor 201 becomes the focused image. More specifically, the raising and lowering controlling section 115 adjusts the first height by repeating a process of changing a height of the image sensor 201 and picking up the test image recorded on the outer peripheral surface 8*a* of the sheet-convey belt 8 until the image based on the image data obtained by the image sensor 201 becomes the focused image. At this time, the raising and lowering controlling section 115 controls the raising and lowering mechanisms 51 to make the fine adjustment of the second height such that the second height is higher than the adjusted first height of the ink-jet heads 2 by a predetermined height, when the mode storing section 111 stores or indicates that the ink-jet printer 1 is in the normal recording mode.

The image analyzing section 119 analyzes the image data obtained by the image sensor 201 which has picked up the test image recorded on the outer peripheral surface 8*a* of the sheet-convey belt 8. The image analyzing section 119 judges, on the basis of a result of the analysis, whether an ink ejection failure, such as non-ejection of the inks, variation of an ejected ink amount, and a deviation of a direction in which the inks are ejected, occurs in any of the ejection openings 3*b* of the respective head bodies 3. Where the image analyzing section 119 has judged that the ink ejection failure occurs, there is determined that the maintenance operation (in this case, the purging operation and the wiping operation of the wiper 72 for the ejection surfaces 3*a*) is needed.

Operations of Ink-Jet Printer

Figure 8:
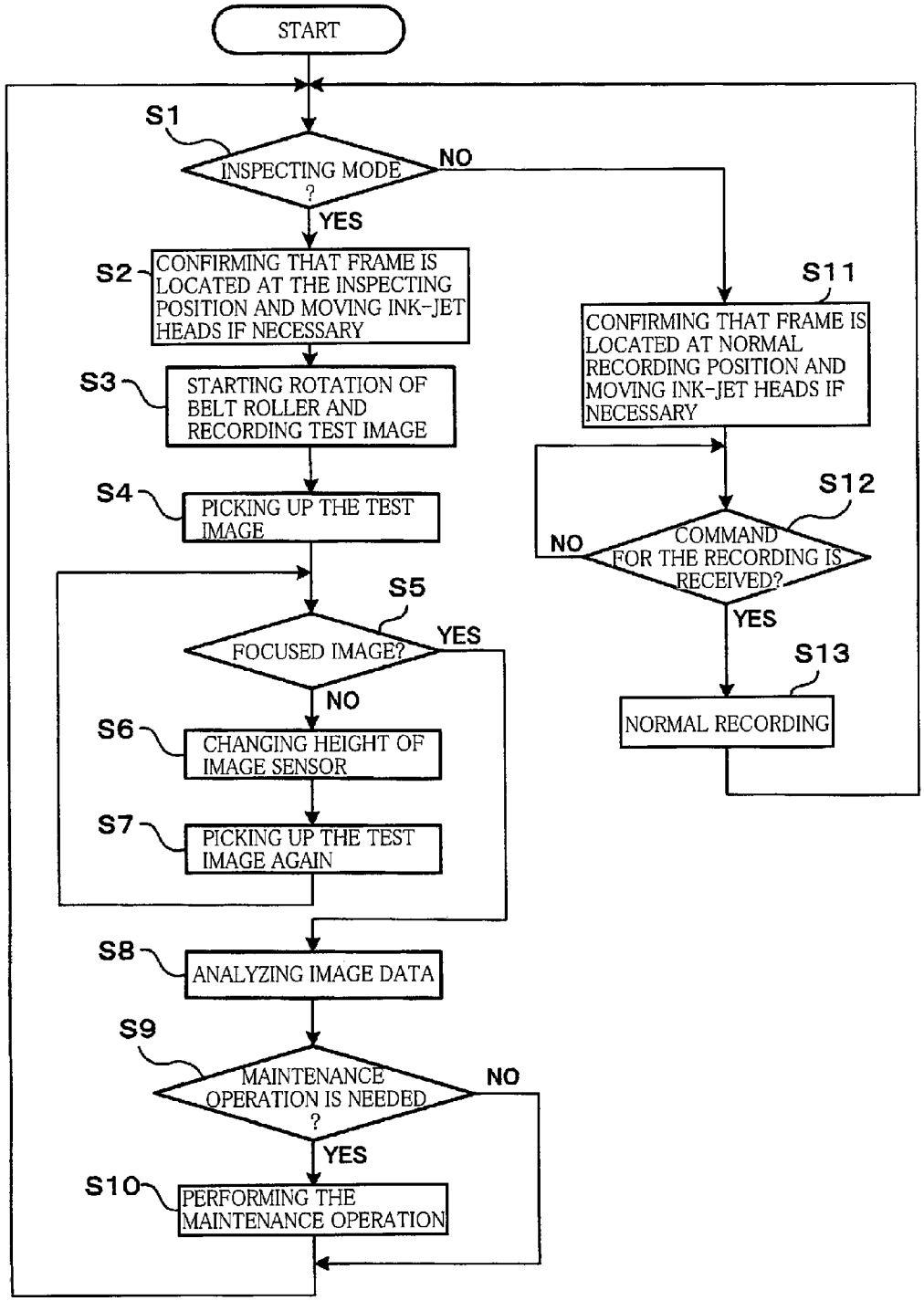
FIG. 8 is a flow-chart showing a processing of a controller of the ink-jet printer.

There will be next explained a processing of the controller 101 with reference to a flow-chart shown in FIG. 8. When the processing of the controller 101 is started, the controller 101 initially judges, in S1, the mode stored in the mode storing section 111 is the normal recording mode or the inspecting mode. Where the mode is the inspecting mode (S1: YES), the processing goes to S2. In S2, a sensor (not shown) confirms that the frame 4 is located at the inspecting position, that is, the ink-jet heads 2 are located at the first height. Where the ink-jet heads 2 are not located at the first height, the raising and lowering controlling section 115 controls the raising and lowering mechanisms 51 such that the ink-jet heads 2 are moved to the first height.

In S3, the sheet-convey controlling section 113 controls the motor driver 123 which drives the sheet-convey motor 133, such that the belt roller 6 is started to be rotated in a state the recording sheet is not held on the outer peripheral surface 8*a* of the sheet-convey belt 8. Further, the head controlling section 112 controls the head driving circuit 121 such that the test image is recorded on the outer peripheral surface 8*a* of the sheet-convey belt 8. At this time, a distance between the ejection surfaces 3*a* and the sheet-convey belt 8 is shorter than that in the normal recording mode. Thus, the ejected-ink-attaching accuracy is relatively high. Accordingly, the ink ejection failure such as the non-ejection of the inks from the ejection openings 3*b* can be detected with a relatively high accuracy. Moreover, since the distance between the ejection surfaces 3*a* and the sheet-convey belt 8 is shorter than that in the normal recording mode, the light-entering surface 201*a* of the image sensor 201 is less soiled due to flying ink mist.

In S4, the image-pickup controlling section 116 controls the image sensor 201 such that the image sensor 201 picks up the test image recorded on the outer peripheral surface 8*a* of the sheet-convey belt 8. The test image recorded on the outer peripheral surface 8*a* is speedily cleaned or removed by the cleaning device 154.

In S5, the focus judging section 118 judges whether the image based on the image data obtained by the pickup operation in S4 is the unfocused image. Originally, since the first height of the ink-jet heads 2 is a height determined such that the image based on the image data obtained by the image sensor 201 which has picked up the test image recorded on the outer peripheral surface 8*a* is the focused image, the image based on the image data obtained by the pickup operation in S4 should be the focused image. However, there is a possibility that the image based on the image data obtained by the pickup operation in S4 is the unfocused image where the first height varies from its initial height with time due to mechanical and structural defects of the raising and lowering mechanisms 51. To solve this problem, in this ink-jet printer 1, the focus judging section 118 judges whether the image based on the image data obtained by the pickup operation in S4 is the unfocused image. Here, on the outer peripheral surface 8*a* of the sheet-convey belt 8, there is recorded a focus judging chart in which black areas and white areas each having a width equal to pixel pitch (resolution) of the image sensor 201 are alternately arranged, for example. When the focus judging chart is picked up, a spatial frequency can be obtained. Whether the image based on the image data obtained by the pickup operation in S4 is the unfocused image is judged on the basis that the spatial frequency is equal to or greater than a threshold value which is near the highest frequency depending upon a form of the focus judging chart.

Where the image based on the image data obtained by the pickup operation in S4 is the unfocused image (S5: NO), the processing goes to S6. Where the image based on the image data obtained by the pickup operation in S4 is the focused image (S5: YES), the processing goes to S8. In S6, the raising and lowering controlling section 115 controls the raising and lowering mechanisms 51 such that the height of the image sensor 201 is changed. Then, in S7, the image-pickup controlling section 116 controls the image sensor 201 such that the image sensor 201 again picks up the test image recorded on the outer peripheral surface 8*a* of the sheet-convey belt 8. The raising and lowering controlling section 115 adjusts the first height by repeating transactions of S7 and S8 until the image based on the image data obtained by the image sensor 201 becomes the focused image. That is, the raising and lowering controlling section 115 adjusts the first height by repeating the process of changing the height of the image sensor 201 and picking up the test image recorded on the outer peripheral surface 8*a* of the sheet-convey belt 8 until the image based on the image data obtained by the image sensor 201 becomes the focused image. In this ink-jet printer 1, the fine adjustment of the first height allows the first height to be maintained to its initial height such that the image based on the image data is always the focused image. Thus, even when the focal depth of the image-forming optical system 203 is shallow, there is no need that an accuracy with which the ink-jet heads 2 are mounted with respect to height (i.e., an accuracy of a height position of the ink-jet heads 2) sets to be extremely high. After the transaction of S7 is completed, the processing returns to S5. In this manner, even where the first height is changed from its initial height with time due to the mechanical and structural defects of the raising and lowering mechanisms 51, the process of changing the height of the image sensor 201 and picking up the test image recorded on the outer peripheral surface 8*a* is repeated until the image based on the image data obtained by the image sensor 201 becomes the focused image, whereby the first height is maintained to its initial height such that the image based on the image data obtained by the image sensor 201 is always the focused image. Thus, even when the focal depth of the image-forming optical system 203 is shallow, there is no need that the accuracy with which the ink-jet heads 2 are mounted with respect to height sets to be extremely high.

In S8, the image analyzing section 119 analyzes the image data obtained in S4 or S7. The image analyzing section 119 judges, on the basis of the result of the analysis, whether the ink ejection failure occurs in any of the ejection openings 3*b* of the ink-jet heads 2. Where the image analyzing section 119 has judged that the ink ejection failure occurs, there is determined, in S9, that the maintenance operation for the ink-jet heads 2 is needed (S9: YES). At this time, where the ink ejection failure occurs in one of the ink-jet heads 2, there may be determined that the maintenance operation is needed only for the one of the ink-jet heads 2. Then, the processing goes to S10 in which the maintenance unit 70 performs the maintenance operation for the ink-jet heads 2. After the maintenance operation is completed, the processing returns to S1.

Figure 9A:
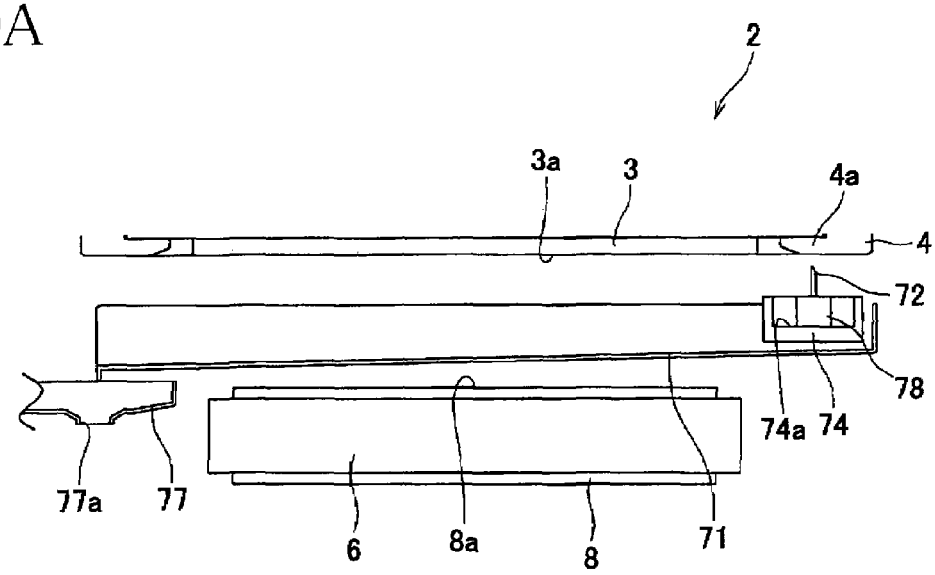
FIGS. 9A and 9B are side views each for explaining a maintenance operation of the ink-jet printer.
Figure 9B:
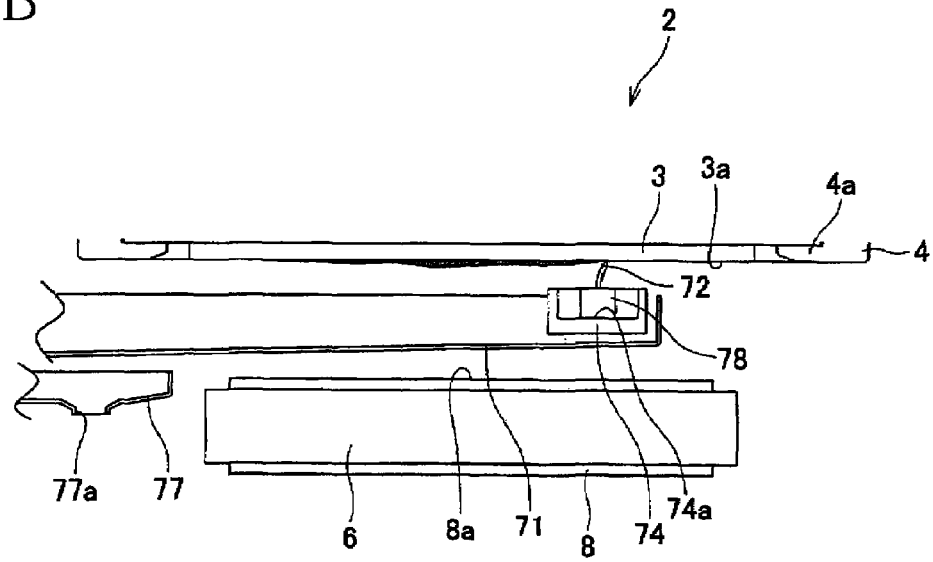

Here, there will be explained the maintenance operation of the ink-jet heads 2 performed in S10 with reference to FIGS. 9A and 9B. FIG. 9A is a side view showing that the frame 4 is moved from the recording position to the maintenance position, and the tray 71 of the maintenance unit 70 is moved to the maintenance position. FIG. 9B is a side view showing that the wiper 72 wipes the inks adhering to the ejection surfaces 3*a*.

When performing the purging operation which is for recovering the ink-jet heads 2 in which the ink ejection failure occurs, the frame 4 is moved to the maintenance position by the raising and lowering mechanisms 51. At this time, the two head motors 52 are driven so as to be synchronized with each other, thereby rotating the pinion gears 53 forwardly (in the clockwise direction in FIG. 3). As a result, the rack gears 54 are moved upward in accordance with the rotations of the pinion gears 53. The frame 4 fixed to the rack gears 54 is moved upward together with the four ink-jet heads 2. When the frame 4 has reached the maintenance position, the rotations of the head motors 52 are stopped.

As a result, between the ejection surfaces 3*a* and the sheet-convey belt 8, there is formed the space in which the maintenance unit 70 can be disposed. When the frame 4 is located at the maintenance position, the respective ejection surfaces 3*a* of the ink-jet heads 2 and the bottom surface of the frame 4 are located at a height position at which the distal ends of the wiper 72 and the circular projections 76*a* are not brought into contact with the respective ejection surfaces 3*a* of the ink-jet heads 2 and the bottom surface of the frame 4 when the maintenance unit 70 is moved to the maintenance position.

Then, the contacting members 84 are respectively brought into contact with the other end portions 83*b* of the respective hooking members 83, whereby the projecting portions 83*a* are respectively moved away from the recessed portions 74*b*. As a result, the recessed portions 74*b* and the respective projecting portions 83*a* are disengaged from each other. That is, the connection of the tray 71 and the tray 75 is released. Then, in this state, the timing belt 95 is moved by the driving of the tray motor 92 of the horizontally moving mechanism 91 such that the tray 71 is moved to the maintenance position. Then, when the tray 71 has reached the maintenance position as shown in FIG. 9A, the tray motor 92 is stopped to be driven.

Subsequently, the pumps (not shown) by which the inks in the respective ink cartridges (not shown) are forced to be introduced into the respective ink-jet heads 2 are driven, thereby performing the purging operation in which the inks are ejected from the ejection openings 3*b* of the ink-jet heads 2 into the tray 71. By performing the purging operation, clogging of the inks in the ejection openings 3*b* in which the ink ejection failure occurs and thickening of the inks in the ejection openings 3*b* are solved. The inks ejected into the tray 71 are moved toward the left side of FIG. 9A on and along a bottom surface of the tray 71, and then flow into the waste-ink receiving tray 77. Then, the inks used in the purging operation are discharged from the ink-discharge opening 77*a* of the waste-ink receiving tray 77. A part of the inks, however, remains on the ejection surfaces 3*a* as ink droplets.

Thereafter, the ink-jet heads 2 are moved downward by the raising and lowering mechanisms 51. At this time, the ink-jet heads 2 are located at a height position at which the distal end of the wiper 72 can be brought into contact with the ejection surfaces 3*a* and the bottom surface of the frame 4 when the tray 71 is moved toward the left side (that is, to the retracted position). Then, as shown in FIG. 9B, the tray 71 is moved toward the left side by the horizontally moving mechanism 91 (that is, the tray 71 is moved from the maintenance position to the retracted position).

By this operation, the wiper 72 is moved in a wiping direction (a first direction) that is directed from the right side toward the left side in FIG. 9A, whereby the wiping operation of the wiper 72 for the ejection surfaces 3*a* is performed. At this time, since the distal end (an upper end) of the wiper 72 is located above a height level of the bottom surface of the frame 4, the wiper 72 contacts with the bottom surface of the frame 4 and the ejection surfaces 3*a* while being deformed or warped, thereby wiping the inks adhering to the ejection surfaces 3*a* by the purging operation. By performing the maintenance operation, the ink-jet heads 2 can be recovered from the ink ejection failure to a normal condition. Then, the processing returns to S1.

As shown in FIG. 8, where the controller 101 judges, in S1, that the ink-jet printer 1 is in the normal recording mode (S1: NO), the processing goes to S11. In S11, the sensor (not shown) confirms that the frame 4 is located at a normal recording position at which the ink-jet heads 2 are located at the second height. Where the ink-jet heads 2 are not located at the second height, the raising and lowering controlling section 115 controls the raising and lowering mechanisms 51 such that the raising and lowering mechanisms 51 move the ink-jet heads 2 to the second height. At this time, the light-entering surface 201*a* of the image sensor 201 is located above a height level of the ejection surfaces 3*a* of the respective ink-jet heads 2. In other words, the light-entering surface 201*a* is more distant from the outer peripheral surface 8*a* than the ejection surfaces 3*a*. Thus, the light-entering surface 201*a* is hardly soiled due to the ink mist. Also, undried inks adhering to the recording sheet hardly adhere to the light-entering surface 201*a*.

Further, in S11, the raising and lowering controlling section 115 controls the raising and lowering mechanisms 51 such that the clearance or the space between the ejection surfaces 3*a* and the recording sheet takes the predetermined value on the basis of the thickness of the recording sheet, thereby making the fine adjustment of the second height. Thus, even where a plurality of the recording sheets of different types which are different from each other in thickness are used, the clearance or the space between the ejection surfaces 3*a* and the recording sheet can be always kept constant. In addition, where a transaction of S6 has been executed, the raising and lowering controlling section 115 controls the raising and lowering mechanisms 51 to make the fine adjustment of the second height such that the second height is located at the position higher than the first height adjusted in S6 by the predetermined height. As a result, the second height is determined to the position higher, by the predetermined height, than the first height, as a reference height, which has been adjusted and does not vary with time. Thus, even when the unadjusted second height varies with time due to the mechanical and structural defects of the raising and lowering mechanisms 51, the second height can be always maintained to its initial height by the fine adjustment of the second height. Accordingly, satisfactory quality of the recording can be sustained.

In S12, the controller 101 waits to receive, from the PC 100, a command for the recording. Where the controller 101 has received the command for the recording, the image is recorded, in S13, on the basis of the controls of the head controlling section 112 and the sheet-convey controlling section 113. Then, after the image has been recorded on the recording sheet, the processing returns to S1.

In this ink-jet printer 1, as described above, the ink-jet heads 2 and the image sensor 201 are moved upward and downward together with each other in a state in which the image sensor 201 is more distant from the outer peripheral surface 8*a* of the sheet-convey belt 8 than the ink-jet heads 2. Thus, the light-entering surface 201*a* of the image sensor 201 is less soiled. When the image is recorded as a test in the inspecting mode, the distance between the ejection surfaces 3*a* and the sheet-convey belt 8 is shorter than in the normal recording mode. Thus, the ejected-ink-attaching accuracy becomes relatively high. In addition, the light-entering surface 201*a* of the image sensor 201 is hardly soiled with the flying ink mist. Further, since the ejected-ink-attaching accuracy becomes relatively high, the ink ejection failure such as the non-ejection of the inks from the ejection openings 3*b* can be detected with relatively high accuracy.

It is to be understood that the present invention is not limited to the details of the illustrated embodiment, but may be embodied with various changes and modifications, which may occur to those skilled in the art, without departing from the spirit and scope of the present invention. For example, the test image may be recorded on the recording sheet placed on the outer peripheral surface 8*a* of the sheet-convey belt 8. In this case, the first height of the ink-jet heads 2 is predetermined such that the optical image of the test image recorded on the recording sheet on the outer peripheral surface 8*a* is formed on the image-pickup element 202 by the image-forming optical system 203 of the image sensor 201. That is, the first height of the ink-jet heads 2 is predetermined such that the image based on the image data obtained when the image sensor 201 picks up the test image recorded on the recording sheet on the outer peripheral surface 8*a* is the focused image.

Further, the image sensor 201 may be disposed on an upstream side of the ink-jet heads 2 in the sheet-convey direction B. Where the image sensor 201 is thus disposed, the sheet-convey belt is circulated once in a state that the recording sheet on which the image has been recorded is placed on the sheet-convey belt, or the image sensor 201 picks up the image after the sheet-convey belt is reversely rotated. A position at which the image sensor 201 is attached is not limited to the side faces of the respective ink-jet heads 2. That is, the image sensor 201 may be attached to the frame 4, and may be attached to other components as long as the image sensor 201 cooperates with and is movable together with the ink-jet heads 2. Further, the above-described function for making the fine adjustment may be omitted.

What is claimed is:

1. An image recording apparatus comprising:

a medium-convey belt which conveys a recording medium;

a recording head having an ejection surface in which a plurality of ejection openings for ejecting liquid are provided and which faces a surface of the medium-convey belt;

an image sensor being integral with the recording head and being movable together with the recording head, and including an image-pickup element, a light-entering surface which faces the surface of the medium-convey belt, and which is more distant from the surface of the medium-convey belt than the ejection surface of the recording head, and an image-forming optical system which guides, to the image-pickup element, a light entered through the light-entering surface and which is for forming, on the image-pickup element, an optical image of an object, a raising and lowering mechanism which positions the recording head at a selected one of a plurality of heights including a first height and a second height, wherein the first height is a height at which the ejection surface is distant from the surface of the medium-convey belt, and the optical image of an image, as the object, recorded on the surface of the medium-convey belt or recorded on the recording medium on the medium-convey belt is formed on the image-pickup element by the image-forming optical system, and wherein the second height is a height at which the ejection surface is more distant from the surface of the medium-convey belt than at the first height; and a controller configured to execute controls for operations of the image recording apparatus, wherein the controller includes:

a mode indicating section configured to indicate one of a normal recording mode and an inspecting mode, wherein in the normal recording mode, a desired image is recorded on the recording medium conveyed on the medium-convey belt while in the inspecting mode, the recording head is inspected;

a raising and lowering controlling section configured to control the raising and lowering mechanism such that the recording head is positioned at the second height when the mode indicating section indicates the normal recording mode, and such that the recording head is positioned at the first height when the mode indicating section indicates the inspecting mode;

a head controlling section configured to control the recording head such that the recording head ejects the liquid; and an image-pickup controlling section configured to control the image sensor such that the image sensor picks up the image recorded on the medium-convey belt or recorded on the recording medium on the medium-convey belt when the recording head is positioned at the first height.

2. The image recording apparatus according to claim 1, wherein the controller further includes a medium-thickness indicating section configured to indicate a thickness of the recording medium which is conveyed by the medium-convey belt, and wherein the raising and lowering controlling section is configured to adjust the second height by controlling the raising and lowering mechanism such that a clearance between the ejection surface and the recording medium takes a predetermined value on the basis of the thickness of the recording medium which is indicated by the medium-thickness indicating section when the mode indicating section indicates the normal recording mode.

3. The image recording apparatus according to claim 1, wherein the controller further includes a focus judging section configured to judge whether an image based on image data obtained by the image sensor is an unfocused image or not, wherein the raising and lowering controlling section is configured to adjust the first height by controlling the raising and lowering mechanism when the focus judging section has judged that the image based on the image data obtained by the image sensor is the unfocused image.

4. The image recording apparatus according to claim 3, wherein the raising and lowering controlling section is configured to adjust the first height by controlling the raising and lowering mechanism, when the focus judging section has judged that the image based on the image data obtained by the image sensor is the unfocused image, such that the image based on the image data obtained by the image sensor becomes a focused image.

5. The image recording apparatus according to claim 3, wherein the raising and lowering controlling section is configured to adjust the first height by repeating a process of changing a height of the image sensor and picking up the image recorded on the medium-convey belt or recorded on the recording medium on the medium-convey belt until the image based on the image data obtained by the image sensor becomes a focused image.

6. The image recording apparatus according to claim 3, wherein the raising and lowering controlling section is further configured to adjust the second height by controlling the raising and lowering mechanism such that the second height is higher than the adjusted first height by a predetermined height when the mode indicating section indicates the normal recording mode.

* * * * *